US008444726B2

(12) United States Patent
Soma et al.

(10) Patent No.: US 8,444,726 B2
(45) Date of Patent: May 21, 2013

(54) METHOD FOR MANUFACTURING GRINDING WHEEL HAVING DEPRESSIONS ON GRINDING SURFACE THEREOF

(75) Inventors: Shinji Soma, Handa (JP); Koji Morita, Anjo (JP); Tomohiro Inagaki, Anjo (JP); Takayuki Moroto, Okazaki (JP); Kazuhiko Sugita, Anjo (JP); Tomoyasu Imai, Kariya (JP); Yasuji Kunihiro, Hekinan (JP)

(73) Assignees: JTEKT Corporation, Osaka-shi (JP); Toyoda Van Moppes Ltd., Okazaki-shi (JP)

( * ) Notice: Subject to any disclaimer, the term of this patent is extended or adjusted under 35 U.S.C. 154(b) by 127 days.

(21) Appl. No.: 12/443,545

(22) PCT Filed: Oct. 19, 2007

(86) PCT No.: PCT/JP2007/070866

§ 371 (c)(1),
(2), (4) Date: Mar. 30, 2009

(87) PCT Pub. No.: WO2008/047949

PCT Pub. Date: Apr. 24, 2008

(65) Prior Publication Data

US 2010/0071271 A1 Mar. 25, 2010

(30) Foreign Application Priority Data

Oct. 20, 2006 (JP) ..... 2006-286268
Jun. 20, 2007 (JP) ..... 2007-162934

(51) Int. Cl.
*B24D 11/00* (2006.01)

(52) U.S. Cl.
USPC ..... 51/297; 51/293; 51/296

(58) Field of Classification Search
USPC ..... 51/293, 296
See application file for complete search history.

(56) References Cited

U.S. PATENT DOCUMENTS 2,201,410 A * 5/1940 Simonds ..... 451/548
2,825,106 A * 3/1958 Rudinger ..... 164/21

(Continued)

FOREIGN PATENT DOCUMENTS

EP 1 174 400 1/2002
EP 1174400 A1 * 1/2002

(Continued)

OTHER PUBLICATIONS

U.S. Appl. No. 12/442,627, filed Mar. 24, 2009, Ido, et al.

(Continued)

*Primary Examiner* — Kaj K Olsen
*Assistant Examiner* — Ross J Christie
(74) *Attorney, Agent, or Firm* — Oblon, Spivak, McClelland, Maier & Neustadt, L.L.P.

(57) ABSTRACT

A grinding wheel is manufactured such that (a) any one of particles for an abrasive grain layer and particles for a substrate layer are put into the press-mold die, and other particles are put onto the particles in the press-mold die, and then the substrate layer and the abrasive grain layer are integrally press-molded to form a non-baked grinding chip with an arcuate shape; (b) depressions are formed on the abrasive grain layer of the non-baked grinding chip; (c) the grinding chip on which the depressions are formed is baked; and (d) the plurality of baked-grinding chips are adhered to a core of the grinding wheel.

3 Claims, 16 Drawing Sheets

U.S. PATENT DOCUMENTS

| | | | | |
|---|---|---|---|---|
| 5,611,724 | A * | 3/1997 | deGraaff | 451/53 |
| 6,283,845 | B1 * | 9/2001 | Fischbacher et al. | 451/542 |

FOREIGN PATENT DOCUMENTS

| | | | | |
|---|---|---|---|---|
| GB | 2309184 | A | * | 7/1997 |
| JP | 62088570 | A | * | 4/1987 |
| JP | 9-193024 | | | 7/1997 |
| JP | 2000 354969 | | | 12/2000 |
| JP | 2001-158674 | A | | 6/2001 |
| JP | 2002 18728 | | | 1/2002 |
| JP | 2003 300165 | | | 10/2003 |
| JP | 2003-300165 | | * | 10/2003 |
| JP | 2003300165 | A | * | 10/2003 |
| JP | 2004175634 | A | * | 6/2004 |
| WO | WO 9947305 | A1 | * | 9/1999 |

OTHER PUBLICATIONS

U.S. Appl. No. 12/421,063, filed Apr. 9, 2009, Mizutani, et al.
U.S. Appl. No. 12/446,313, filed Apr. 20, 2009, Soma, et al.
Office Action issued May 8, 2012, in Japanese Patent Application No. 2007-162934 with partial English translation.

* cited by examiner

METHOD FOR MANUFACTURING GRINDING WHEEL HAVING DEPRESSIONS ON GRINDING SURFACE THEREOF

TECHNOLOGICAL FIELD

The present invention relates to a method for manufacturing a grinding wheel having depressions on a grinding surface thereof, wherein depressions with a shape of inclined groove or a hole are formed on segment type grinding chips which are adhered to a core of the grinding wheel.

BACKGROUND ART

A grinding wheel disclosed in Japanese Patent Laid-open Publication No. 2000-354969 ([0007], [0026], FIG. 1), includes an abrasive grain layer in which inclined grooves are formed on a grinding surface formed on a periphery of the abrasive grain layer. More specifically, the abrasive grain layer contains superabrasive grains such as diamond or cubic boron nitride, and is adhered to a periphery surface of a disc-type core that is rotated about its axis. The inclined grooves have a predetermined width and depth, and are inclined at an angle of approximately 25 to 45 degrees to the axis of the core. Compared with the conventional grinding wheel having no grooves, the grinding wheel having grooves increases the grinding amount approximately 1.5 times because grinding fluid can be effectively introduced into a grinding point along the inclined grooves.

Further, grinding fluid introduced into a grinding point generates a dynamic pressure between a workpiece and a grinding wheel. Such pressure causes the workpiece to displace relative to the grinding wheel, thereby decreasing machining accuracy and efficiency. It is considered to release the dynamic pressure by forming the grooves on the grinding surface of the grinding wheel. In addition, it is also considered to form a plurality of holes on the grinding surface of the grinding wheel, instead of such grooves, in order to release the dynamic pressure.

DISCLOSURE OF THE INVENTION

Problem To Be Solved By the Invention

In order to form the grooves on the grinding surface of the grinding wheel, if the inclined grooves are formed by machining process on the grinding surface of a baked grinding chip adhered to the core of the grinding wheel, it is difficult to process the inclined grooves or the hole-shaped depressions by reason of, for example, remarkable wearing of the grinding wheel for forming the grooves or depressions because the inclined grooves or hole-shaped depressions are formed by the machining process at the abrasive grain layer in which the superabrasive grains are maintained by strong bond. The baked grinding chip is formed by press molding superabrasive grains and the bond, and then baking the press-molded superabrasive grains and the bond. In addition, if the inclined grooves or the hole-shaped depressions are formed through the machining process on the baked abrasive grain layer of the grinding wheel, a retentivity of the superabrasive grains exposed on the grinding surface at a side wall portion of the inclined groove or at an inner wall portion of the hole-shaped depression is reduced by the machining process, and thus it makes the superabrasive grains easily dropout.

Therefore, the present invention is to form inclined grooves or hole-shaped depressions easily, which are inclined relative to the circumferential direction of a grinding wheel, on an abrasive grain layer of a non-baked grinding chip through a machining process or a press-molding process, at a low cost.

Means To Solve the Problem

In the invention described in claim 1, which is made to accomplish the aforementioned object, it is provided a method for manufacturing a grinding wheel having depressions on a grinding surface thereof, which comprises a plurality of grinding chips that include a substrate layer and an abrasive grain layer containing superabrasive grains, wherein the grinding chips are adhered to a core mounted to a wheel spindle that is rotatably journalled in a wheel head of a grinding machine, and the grinding surface formed on the abrasive grain layer contacts with a workpiece, which is rotatably supported on a workpiece supporting apparatus of the grinding machine, to grind the workpiece at a grinding point, wherein the method comprising; forming the grinding chip before baking in such a manner that a substrate layer formed by mixing substrate grains with bond is overlaid on an inner surface of an abrasive grain layer and is integrally press-molded with the abrasive grain layer to form the grinding chip with an arcuate shape, wherein the abrasive grain layer is formed by mixing superabrasive grains with the bond; forming a plurality of depressions on an abrasive grain layer of the non-baked grinding chip; baking the non-baked grinding chips, thereby making baked grinding chips; and adhering a plurality of baked grinding chips to the core.

The invention described in claim 2 is structurally characterized in that in the method according to claim 1, the depressions are inclined grooves which are inclined relative to the circumferential direction of the grinding wheel; and the inclined grooves are formed on the non-baked abrasive grain layer through a machining process.

The invention described in claim 3 is structurally characterized in that in the method according to claim 1 or 2, the inclined grooves are formed on the abrasive grain layer through the machining process such that the inclined grooves reach to the substrate layer from the grinding surface.

The invention described in claim 4 is structurally characterized in that in the method according to claim 1 through 3, the inclined grooves are formed on the abrasive grain layer through the machining process in such a manner that a tool is linearly moved relative to the non-baked grinding chip in a direction of an inclination angle of the inclined groove.

The invention described in claim 5 is structurally characterized in that in the method according to claim 1, the depressions are inclined grooves which are inclined relative to the circumferential direction of the grinding wheel; at the time when the press-molding is performed, disposing a plurality of inclined groove forming plates for forming the inclined grooves at a grinding surface forming surface of a press-mold die for molding the grinding chip, wherein the inclined groove forming plates are made of carbon or resin, and are respectively inclined relative to a direction corresponding to the circumferential direction of the grinding wheel where the grinding chips are to be adhered to the core thereof; putting particles for the abrasive grain layer into the press-mold die, and putting particles for the substrate layer onto the particles for the abrasive grain layer to be overlaid on the abrasive grain layer in the press-mold die, wherein the particles for the abrasive grain layer is formed by mixing the superabrasive grains with the bond, and the particles for the substrate layer is formed by mixing substrate grains with the bond; integrally press-molding the particles for the abrasive grain layer and the particles for the substrate layer in such a manner that the substrate layer to be formed is not divided by the inclined groove forming plate; removing the non-baked grinding chip from the press-mold die, wherein the abrasive grain layer and the substrate layer are integrally press-molded in a state that the inclined groove forming plates penetrate through the abrasive grain layer; and at the time when the chip baking is performed, forming the baked grinding chip in such a manner that the inclined groove forming plates are burned away while the grinding chip is baked, and thereby the inclined grooves inclined relative to the circumferential direction of the grinding wheel are formed on the abrasive grain layer.

The invention described in Claim 6 is structurally characterized in that in the method according to claim 1, the depressions are inclined grooves which are inclined relative to the circumferential direction of the grinding wheel; at the time when the press-molding is performed, disposing a plurality of inclined groove forming plates for forming the inclined groove at a grinding surface forming surface of a press-mold die for molding the grinding chip, wherein the inclined groove forming plates are made of metal, and are respectively inclined relative to a direction corresponding to the circumferential direction of the grinding wheel where the grinding chips are to be adhered to the core thereof; putting particles for the abrasive grain layer into the press-mold die, and putting particles for the substrate layer onto the particles for the abrasive grain layer in the press-mold die to be overlaid on the abrasive grain layer, wherein the particles for the abrasive grain layer is formed by mixing the superabrasive grains with the bond, and the particles for the substrate layer is formed by mixing substrate grains with the bond; integrally press-molding the particles for the abrasive grain layer and the particles for the substrate layer in such a manner that the substrate layer to be formed is not divided by the inclined groove forming plate; removing the abrasive grain layer and the substrate layer integrally formed by the press-molding from the press-mold die, thereby forming the non-baked grinding chip, wherein the inclined grooves inclined relative to the circumferential direction of the grinding wheel are formed on the abrasive grain layer by removing the plurality of inclined groove forming plates from the abrasive grain layer.

The invention described in claim 7 is structurally characterized in that in the method according to claim 1, the depressions are hole-shaped depressions formed on the grinding surface; at the time when the press-molding is performed, disposing a plurality of pin members made of carbon or resin at a grinding surface forming surface of a press-mold die for molding the grinding chip; putting any one of particles for the abrasive grain layer and particles for the substrate layer into the press-mold die, and putting the other particles onto the particles in the press-mold die, wherein the particles for the abrasive grain layer is formed by mixing the superabrasive grains with the bond, and the particles for the substrate layer is formed by mixing substrate grains with the bond; integrally press-molding the particles for the abrasive grain layer and the particles for the substrate layer in such a manner that the plurality of pin members penetrate through at least the abrasive grain layer; removing the non-baked grinding chip from the press-mold die, wherein the abrasive grain layer and the substrate layer are integrally press-molded; and at the time when the chip baking is performed, forming the baked grinding chip in such a manner that the pin members are burned away while the grinding chip is baked, and thereby the plurality of hole-shaped depressions are formed on the grinding surface of the abrasive grain layer.

The invention described in claim 8 is structurally characterized in that in the method according to claim 1, the depressions are a plurality of hole-shaped depressions formed on the grinding surface; at the time when the press-molding is performed, disposing a plurality of pin members made of metal on a press-mold die for forming the grinding chip; putting any one of particles for the abrasive grain layer and particles for the substrate layer into the press-mold die, and putting the other particles onto the particles in the press-mold die, wherein the particles for the abrasive grain layer is formed by mixing the superabrasive grains with the bond, and the particles for the substrate layer is formed by mixing substrate grains with the bond; integrally press-molding the particles for the abrasive grain layer and the particles for the substrate layer in such a manner that the plurality of pin members penetrate through at least the abrasive grain layer; removing the non-baked grinding chip from the press-mold die, wherein the abrasive grain layer and the substrate layer are integrally press-molded; and by removing the plurality of pin members from the abrasive grain layer, thereby forming the plurality of hole-shaped depressions opening at the grinding surface on the abrasive grain layer.

Effect of the Invention

According to the invention described in claim 1, the plurality of depressions are formed on the non-baked grinding chip, and then the grinding chip is baked. The machining process performed on the baked chip reduces the retentivity of the superabrasive grains exposed on the grinding surface at the inside wall portions of the depressions. However, in the present invention, as it is not necessary to perform the machining process on the baked chip to form the depressions, the retentivity of the superabrasive grains exposed on the grinding surface at the inside wall portions of the depressions is not reduced. Thus, the highly durable grinding wheel having superabrasive grains strongly combined with the bond can be easily manufactured at a low cost.

According to the invention described in claim 2, the non-baked grinding chip is formed by overlaying the substrate layer on the inner surface of the abrasive grain layer, and then by integrally press-molding the abrasive grain layer and the substrate layer in an arcuate shape. Subsequently, the grooves inclined relative to the circumferential direction of the grinding wheel are formed on the abrasive grain layer of the non-baked grinding chip. In the baked grinding chip, the superabrasive grains are strongly bound by the bond through a baking process. However, as the superabrasive grains are weekly bonded by the bond in the non-baked chip that is not yet baked, wear of a tool for forming the grooves is reduced, and the inclined grooves are easily formed at a low coat. Furthermore, as the grinding chip is baked after the inclined grooves are formed thereon, the superabrasive grains exposed from the bond due to the machining process are coated and bonded with the bond which is molten while baking, and thereby the retentivity of the superabrasive grains is not reduced by the machining process. Plural grinding chips are adhered to the core. Therefore, the grinding wheel having the inclined grooves, which has strong resistance to wear, can be easily manufactured at a low cost.

According to the invention described in claim 3, because the inclined grooves are formed in the abrasive grain layer such that the inclined grooves reach to the substrate layer from the grinding surface, the entire thickness of the abrasive grain layer can be effectively used for grinding. Consequently, the grinding wheel life can be elongated.

According to the invention described in claim 4, because the inclined grooves are formed in such a manner that a tool for forming the inclined groove is linearly moved relative to the non-baked grinding chip in a direction of the inclination angle of the inclined groove, processing time can be shortened and thus the inclined grooves can be easily formed compared with a method where the inclined grooves are formed in a spiral shape.

According to the invention described in claim 5, the non-baked grinding chip is formed in such a manner that a plurality of inclined groove forming plates made of carbon or resin for forming the inclined grooves are disposed at a grinding surface forming surface of a press-mold die, the particles for the abrasive grain layer are put into the press-mold die, and the particles for the substrate layer are put onto the particles for the abrasive grain layer in the press-mold die. The particles for the abrasive grain layer and the particles for the substrate layer are integrally press-molded in such a manner that the substrate layer to be formed is not divided by the inclined groove forming plate, and the inclined grooves are formed through the abrasive grain layer. Therefore, the process in which the inclined grooves are formed can be eliminated. The machining process performed on the baked chip reduces the retentivity of the superabrasive grains exposed on the grinding surface at the inside wall portions of the inclined grooves. However, as it is not necessary to perform the machining process on the baked chip to form the inclined grooves, the retentivity of the superabrasive grains exposed on the grinding surface at the inside wall portions of the inclined grooves is not reduced by the machining process. Thus, the highly durable grinding wheel having superabrasive grains combined with the bond can be easily manufactured at a low cost. In addition, because the inclined groove forming plates made of carbon or resin can be burned away at the high temperature when the grinding chip is baked, the process in which inclined groove forming plates are removed from the non-baked grinding wheel can be eliminated, thereby improving the manufacturing efficiency. When the inclined groove forming plates are burned away, the edge of the inclined grooves of the grinding chip is not damaged or deformed, thereby improving the quality of the grinding chip.

According to the invention described in claim 6, the non-baked grinding chip is formed in such a manner that a plurality of inclined groove forming plates made of metal for forming the inclined grooves are disposed at a grinding surface forming surface of a press-mold die, the particles for the abrasive grain layer are put into the press-mold die, and the particles for the substrate layer are put onto the particles for the abrasive grain layer in the press-mold die. The particles for the abrasive grain layer and the particles for the substrate layer are integrally press-molded in such a manner that the substrate layer is not divided by the inclined groove forming plate. Then, the integrally formed abrasive grain layer and substrate layer are removed from the press-mold die. The plurality of inclined groove forming plates are removed from the abrasive grain layer, so that the grooves inclined relative to the circumferential direction of the grinding wheel are formed on the abrasive grain layer. Therefore, the process in which the inclined grooves are formed can be eliminated. The machining process performed on the baked chip reduces the retentivity of the superabrasive grains exposed on the grinding surface at the inside wall portions of the inclined grooves. However, as it is not necessary to perform the machining process on the baked chip to form the inclined grooves, the retentivity of the superabrasive grains exposed on the grinding surface at the inside wall portions of the inclined grooves is not reduced. Thus, the highly durable grinding wheel having superabrasive grains combined with the bond can be easily manufactured at a low cost.

According to the invention described in claim 7, the non-baked grinding chip is formed in such a manner that a plurality of pin members made of carbon or resin are disposed at a grinding surface forming surface of a press-mold die, the particles for the abrasive grain layer are put into the press-mold die, and the particles for the substrate layer are put onto the particles for the abrasive grain layer in the press-mold die. The abrasive grain layer and the substrate layer are integrally press-molded in such a manner that the plurality of pin members penetrate through at least the abrasive grain layer. Therefore, the process in which the plurality of hole-shaped depressions are formed can be eliminated. The machining process performed on the baked chip reduces the retentivity of the superabrasive grains exposed on the grinding surface at the inside wall portions of the hole-shaped depressions. However, as it is not necessary to perform the machining process on the baked chip to form the hole-shaped depressions, the retentivity of the superabrasive grains exposed on the grinding surface at the inside wall portions of the hole-shaped depressions is not reduced by the machining process. Consequently, the highly durable grinding wheel having superabrasive grains combined with the bond can be easily manufactured at a low cost.

Because the pin members can be burned away at the high temperature when the grinding chip is baked, the process in which the pin members are removed from the non-baked grinding wheel can be eliminated, thereby improving the manufacturing efficiency. Furthermore, when the pin members are burned away, the edge of the hole-shape depressions of the grinding chip is not damaged or deformed, improving the quality of the grinding chip.

According to the invention described in Claim 8, the non-baked grinding chip is formed in such a manner that a plurality of pin members made of metal are disposed at a grinding surface forming surface of a press-mold die, the particles for the abrasive grain layer are put into the press-mold die, and the particles for the substrate layer are put onto the particles for the abrasive grain layer in the press-mold die. The abrasive grain layer and the substrate layer are integrally press-molded in such a manner that the plurality of pin members penetrate through at least the abrasive grain layer. Then, the integrally formed abrasive grain layer and substrate layer are removed from the press-mold die. The plurality of pin members are removed from the abrasive grain layer, so that the plurality of hole-shaped depressions are formed on the abrasive grain layer. Therefore, the process in which the hole-shaped depressions are formed can be eliminated. The machining process performed on the baked chip reduces the retentivity of the superabrasive grains exposed on the grinding surface at the inside portions of the hole-shaped depressions. However, as it is not necessary to perform the machining process on the baked chip to form the hole-shaped depressions, the retentivity of the superabrasive grains exposed on the grinding surface at the inside portions of the hole-shaped depressions is not reduced. Thus, the highly durable grinding wheel having superabrasive grains combined with the bond can be easily manufactured at a low cost.

DESIGNATION OF SYMBOLS

10 - - - grinding wheel, 11 - - - grinding chip, 12 - - - abrasive grain layer, 13 - - - substrate layer, 14 - - - core, 15 - - - grinding surface, 16 - - - superabrasive grain, 17 - - - vitrified bond, 20 - - - inclined groove, 21, 22 - - - side surface, 30 - - - coolant nozzle, 41, 81, 91, 101 - - - outer die, 42, 82, 92, 102 - - - lower die, 45, 85, 95, 105 - - - first upper die, 47, 87, 97, 107 - - - second upper die, 60 - - - groove machining apparatus, 61 - - - grinding wheel for machining a groove, 68 - - - jig, 69 - - - spindle, 83 - - - inclined groove forming plate, 93, 103 - - - pin member, P - - - grinding point, W - - - workpiece, $\alpha$ - - - inclination angle.

PREFFERRED EMBODIMENT TO PRACTICE THE INVENTION

Figure 1:
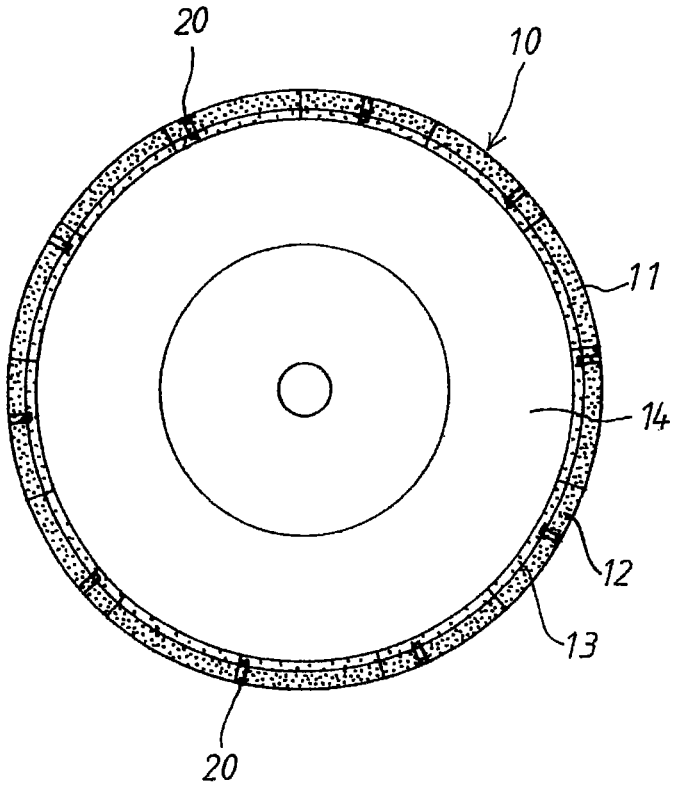
FIG. 1 illustrates an entire grinding wheel configured of segment type grinding chips in accordance with a first embodiment of the present invention.

Hereinafter, a first embodiment of the present invention will be described with reference to the drawings. FIG. 1 illustrates a grinding wheel 10 including a segment type grinding chip 11 which is manufactured by a method of the first embodiment. The grinding chip 11 of the grinding wheel 10 includes an abrasive grain layer 12, which is formed on a periphery thereof and is made by bonding superabrasive grains with vitrified bond. Also, the grinding chip 11 includes a substrate layer, or lower layer 13 containing no superabrasive grains, which is overlaid on the inner surface of the abrasive grain layer 12 and integrally formed with the abrasive grain layer 12. The grinding wheel 10 is configured such that a plurality of grinding chips 11, each of which is composed of the abrasive grain layer 12 and the substrate layer 13 and is formed in an arcuate shape, are coaxially arranged and adhered to the periphery of a disc like core 14 at a bottom surface of the substrate layer 13 by means of an adhesive. The core 14 is formed of a metal such as iron and aluminum or resin. In reference to FIG. 2, the grinding wheel 10 is mounted at the core 14 to a wheel spindle 32 which is rotatably journalled in a grinding wheel head 31 of a grinding machine 30 and is rotated about an axis O. A workpiece W is rotatably supported on a workpiece supporting apparatus 33 of the grinding machine 30. As the grinding wheel head 31 advances toward the workpiece W, a grinding process on the periphery of the workpiece W is performed by bringing a grinding surface 15 formed on the abrasive grain layer 12 of the grinding wheel 10 into contact with the workpiece W at a grinding point P.

Figure 3:
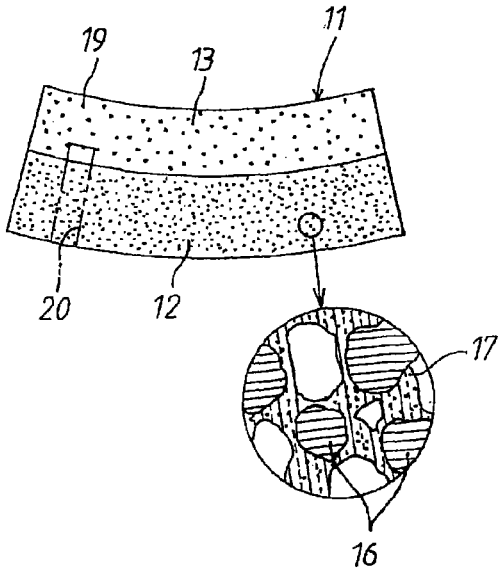
FIG. 3 illustrates a grinding chip.
Figure 4:
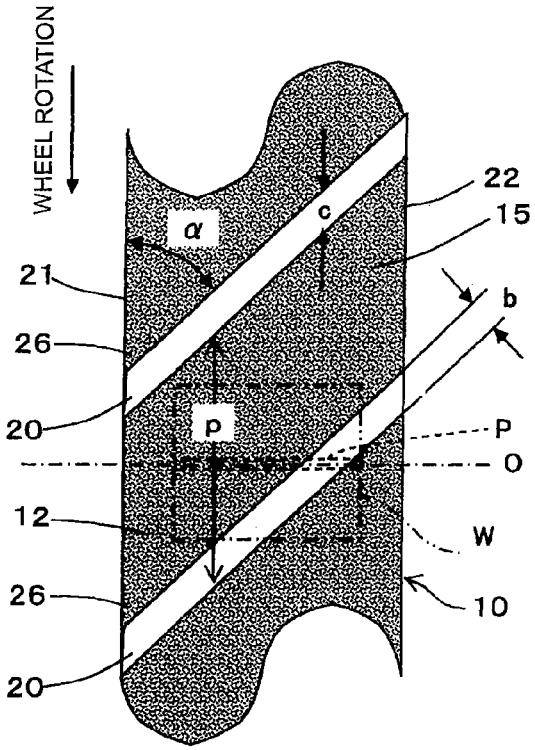
FIG. 4 illustrates the plurality of inclined grooves formed on the grinding surface of the grinding wheel so that at least one of the inclined grooves always passes through a grinding point.

FIG. 3 illustrates the grinding chip 11 which is formed in an arcuate shape. The grinding grain layer 12 is formed by binding the superabrasive grains 16 such as CBN grains and diamond grains with vitrified bond 17 with thickness between 3 and 7 mm. Grains such as aluminum oxide ($Al_2O_3$) grains may be mixed with the superabrasive grains in the grinding grain layer 12 in order to adjust a concentration. The substrate layer 13 is formed by bonding substrate grains 19 for substrate layer with vitrified bond 17 with thickness between 2 and 4 mm. The vitrified bond 17 improves both the efficiency of discharging swarf and the grinding efficiency owing to its porous characteristic, thereby being able to grind a workpiece with a fine surface roughness and to reduce the wear amount of the grinding wheel. However, bond such as resin bond or metal bond etc. may be used, instead of the vitrified bond 17. As illustrated in FIG. 4, a plurality of inclined grooves inclined relative to an axis O are formed on the grinding surface 15 of the grinding wheel 10, in which at least one of the inclined grooves passes upward and downward through the grinding point P, independently of a rotational phase of the grinding wheel 10. With this configuration, since at least one of the inclined grooves always passes through the grinding point P, the dynamic pressure generated in the grinding fluid supplied to the grinding point P between the grinding surface 15 and the workpiece is released through both an upper side and a lower side of the grinding point P. Therefore, it is prevented that the workpiece is displaced by the dynamic pressure in a direction away from the grinding wheel 10 to increase the dimension of the workpiece W. As a result, a grinding accuracy, especially out-of-roundness, is improved. On the contrary, if at least one of the inclined grooves does not always passes through the grinding point P, so that the inclined groove is opened only into the upper side of the grinding point P, the dynamic pressure at the lower side of the grinding point P is not released. Similarly, if the inclined groove is opened only into the lower side of the grinding point P, the dynamic pressure at the upper side of the grinding point P is not released. Each inclined groove 20 is formed on the grinding wheel surface 15 through the both side surfaces 21, 22 of the abrasive grain layer 12 that is perpendicular to the axis O of the grinding wheel.

Under the conditions described hereinafter, it will be easy to form the inclined grooves 20, and it is possible to effectively prevent the grinding fluid supplied to the grinding point P from generating the dynamic pressure, to expand the lifetime of the grinding wheel, and to ensure a high grinding precision. First, it is preferable that at least one, preferably more than two of the inclined grooves 20 passes thorough the grinding point P within the width of the workpiece W, that is within a length of the grinding point P in an axis direction thereof, independently of the rotational phase of the grinding wheel 10. Also, it is preferable that the width c of the each inclined groove 20 in the circumferential direction of the grinding wheel is narrow because a distance between the superabrasive grains 16 exposed on the grinding surface 15 becomes larger as much as the width c of the inclined groove 20. To reduce the number of processes of work, it is preferable to reduce the number of the inclined grooves. Also, it is preferable that a pitch between the inclined grooves 20 in the circumferential direction of the grinding wheel is long because, if the pitch is short, it is difficult to form the inclined grooves 20 and strength of the grinding chip 11 is reduced. In addition, the total area of the inclined grooves 20 should not be large because, if so, the number of the superabrasive grains that perform grinding 16 is reduced, thereby increasing the wear amount of the grinding wheel.

Next, described hereinafter is a method for suitably deciding on the number n and an inclination angle α of the inclined grooves 20 based on the above-mentioned conditions, wherein, for instance, a workpiece W with a width of 15 mm is ground in a plunge-cutting type by the grinding wheel 10 with an outer diameter of 350 mm. The inclination angle α is an angle formed between the inclined groove 20 and the side surface 21 of the abrasive grain layer 12. In other words, the inclination angle α is the angle relative to the circumferential direction of the grinding wheel 10. A length of the grinding point P in an axis direction is 15 mm equal to the width of the workpiece W.

Figure 5:
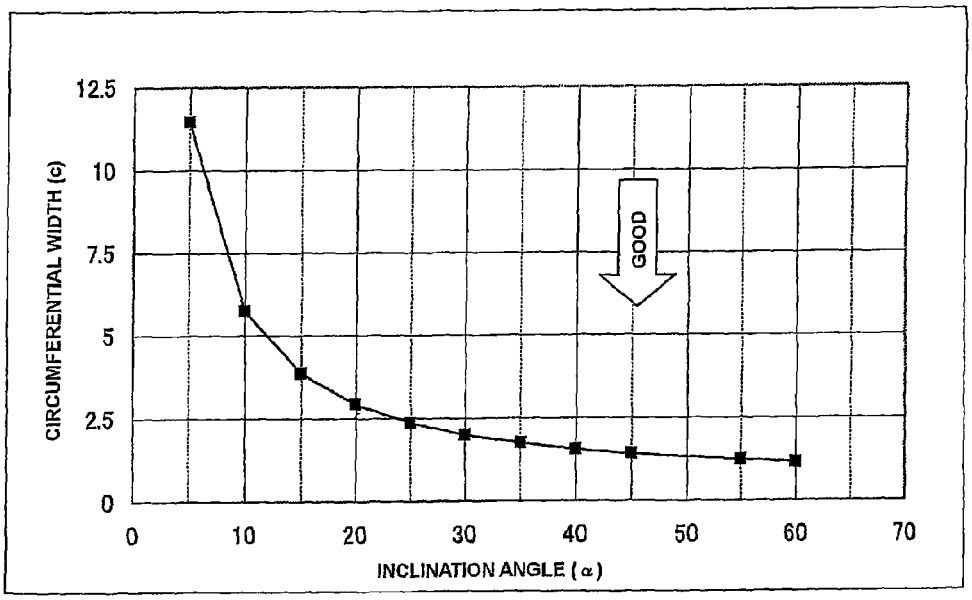
FIG. 5 illustrates a relationship between a circumferential width and an inclination angle of the grooves.

Also, it is preferable that a width b of the inclined grooves 20 in a normal direction to the inclined groove is about 1 mm, to obtain the strength of the grinding wheel for forming a groove and to make the width c of the inclined grooves 20 narrow. The width c is the width of the inclined groove 20 in the circumferential direction. FIG. 5 illustrates the relationship between the width c and the inclination angle α of the inclined groove 20. In FIG. 5, the ratio of the width c to the inclination angle α becomes small, as the inclination angle α becomes larger than 15 degree, and thereby it can be restrained that the distance between the superabrasive grains increases due to the inclined grooves 20.

Figure 6:
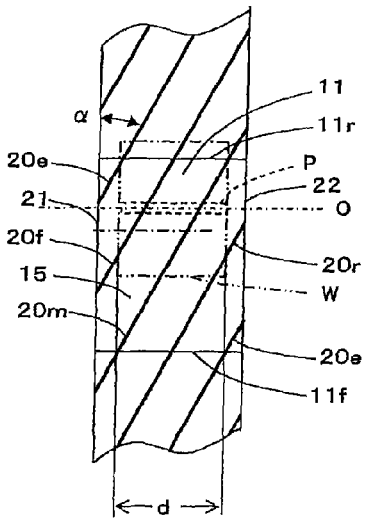
FIG. 6 illustrates two inclined grooves formed on the grinding surface of the grinding wheel so that the two inclined grooves always pass through the grinding point which has the length in an axis direction equal to the width of the workpiece.
Figure 7:
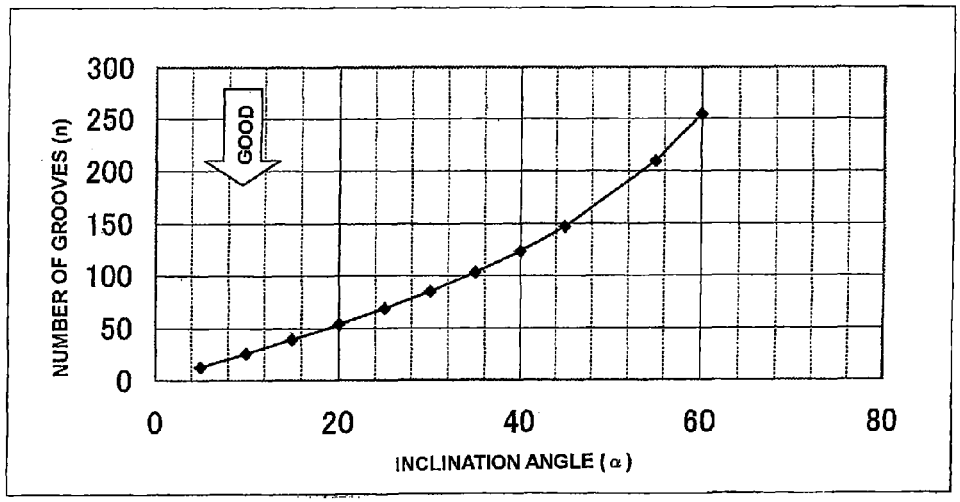
FIG. 7 is a graph which shows a relationship between the inclination angle and the number of the inclined grooves.
Figure 8:
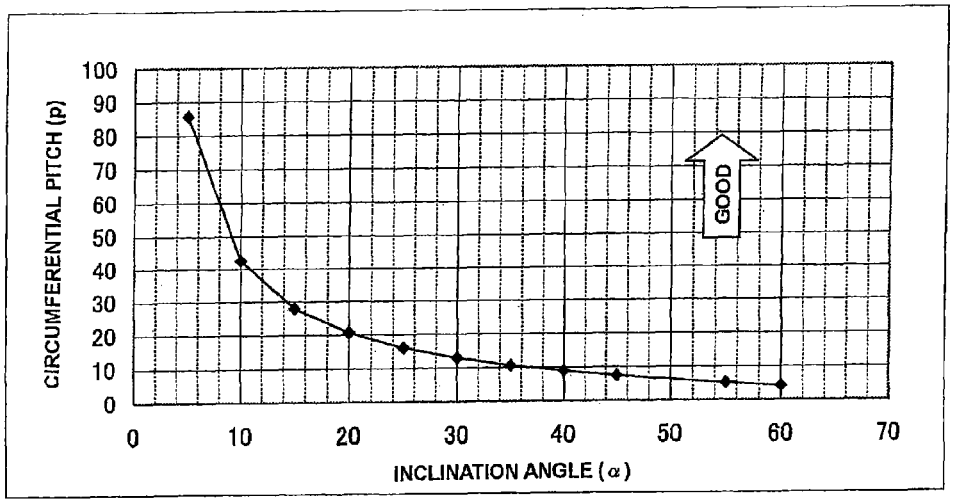
FIG. 8 illustrates a relationship between the inclination angle of the inclined grooves and a pitch thereof in the circumferential direction of the grinding wheel.
Figure 9:
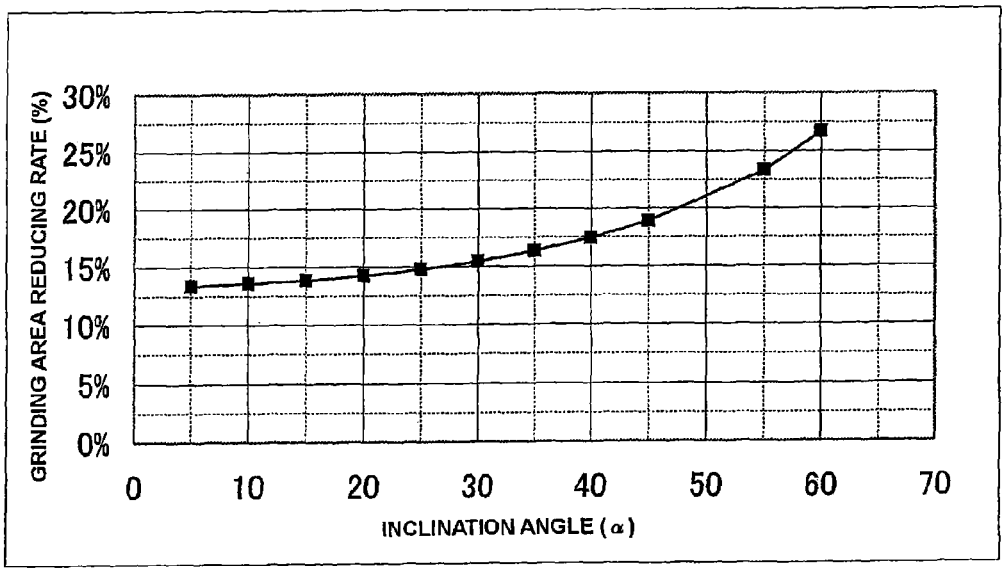
FIG. 9 illustrates a relationship between the inclination angle of inclined grooves and the area reduction ratio of the grinding surface.

FIG. 6, illustrates the situation where two inclined grooves 20 pass through the grinding point P which has a length equal to the width of the workpiece W, independently of the rotational phase of the grinding wheel 10, in a range d in which, for instance, the grinding peripheral surface 15 of the grinding wheel 10 with an outer diameter 350 mm contacts with the workpiece W having a width 15 mm. FIG. 7 shows the relationship between the inclination angle α and the number n of the inclined grooves 20, FIG. 8 shows the relationship between the inclination angle α and the pitch p between inclined grooves 20 in the circumferential direction of the grinding wheel, and FIG. 9 shows a relationship between the inclination angle α and the area reducing ratio of the grinding surface due to the inclined grooves 20, respectively. As illustrated clearly in FIG. 8, where the inclination angle α becomes smaller than about 15 degree, the pitch p of the inclined groove 20 in the circumferential direction becomes sufficiently large, thereby not affecting the forming the inclined groove 20. In addition, as illustrated in FIG. 9, where the inclination angle α becomes smaller than about 15 degree, the area reduction ratio of the grinding surface 15 due to the grooves can be kept low. Also, as illustrated in FIG. 7, where the inclination angle α is about 15 degree, the number n of the inclined grooves 20 can be reduced. In view of those points, it is preferable that the inclination angle α is a value closer to 15 degree.

The specifications of the grooves are decided under the conditions where at least two of inclined grooves 20 pass through the grinding point P within the width of the workpiece, that is, within the length of the grinding point P in the axis direction, independently of the rotational phase of the grinding wheel 10 in a case where the workpiece W with a width of 15 mm is ground in a plunge cutting type through the grinding wheel 10 with an outer diameter of 350 mm. The decided specifications, for instance, are as follows, wherein the width of the inclined groove is 1 mm, the depth of the inclined groove is 6 mm, the inclination angle α is 15 degree, the number of the inclined groove is 39, and the pitch p of the inclined groove in the circumferential direction of the grinding wheel 28 is 1 mm.

In order to form the inclined groove 20 having the above-mentioned specifications on the grinding surface 15 of the grinding wheel 10 that has a twice width to the workpiece W with a width of 15 mm, for instance, as shown in FIG. 6, five inclined grooves 20 are formed on the grinding chip 11 having a width of 30 mm with a pitch of about 28.1 mm in the circumferential direction. In the case where the five inclined grooves 20 are formed on the grinding chip 11, a front half portion 20*f* and a rear half portion 21*r* of the inclined grooves 20 are formed on the chip 11 from the center of the both circumferential end surfaces to the both side surfaces 21, 22 thereof with the inclination angle of 15 degree respectively. And a center portion 20*m* of the inclined groove 20 is formed between the portions 20*f* and 20*r*. Further, both end portions 20*e* of the inclined grooves 20 are formed, which respectively connect with end of the center portion 20*m* of the adjacent grinding chips 11 after the grinding chips 11 are adhered to the core 14. As the ends of the front half and rear half portions 20*f*, 20*r* and the center of the center portion 20*m* of the inclined groove 20 are disposed on a center line of the grinding chip 11 in a width direction, the length of the grinding chip 11 in the circumferential direction is about 56 mm somewhat shorter than as much as 2 pitches.

Described hereinafter is a method (the first embodiment) for manufacturing the grinding chip 11 with reference to FIG. 10A. An outer die 41 has a rectangular through cavity. A lower die 42 is fitted in the bottom portion of the through cavity of the outer die 41. A concavity 42*a* is formed on an upper surface of the lower die 42. The concavity 42*a* has an arcuate shape corresponding to an arcuate surface of the grinding chip 11 forming an outer periphery of the grinding wheel 10. The outer die 41 and the lower die 42 constitute a press-mold die for molding the grinding chip, and the surface of the concavity 42*a* constitutes a grinding surface forming surface of the press-mold die for molding the grinding chip. Particles 44 for the abrasive grain layer are put onto the lower die 42 in the outer die 41, and the particles 44 are leveled into uniform thickness (process 51 in FIG. 11). Then, as illustrated in FIG. 10B, a first upper die 45 as a press die is moved downward along the inner surface of the outer die 41, subsequently the particles 44 for the abrasive grain layer is pre-pressed, so that the abrasive grain layer 12 is pre-molded in an arcuate shape (process 52).

Figure 10:
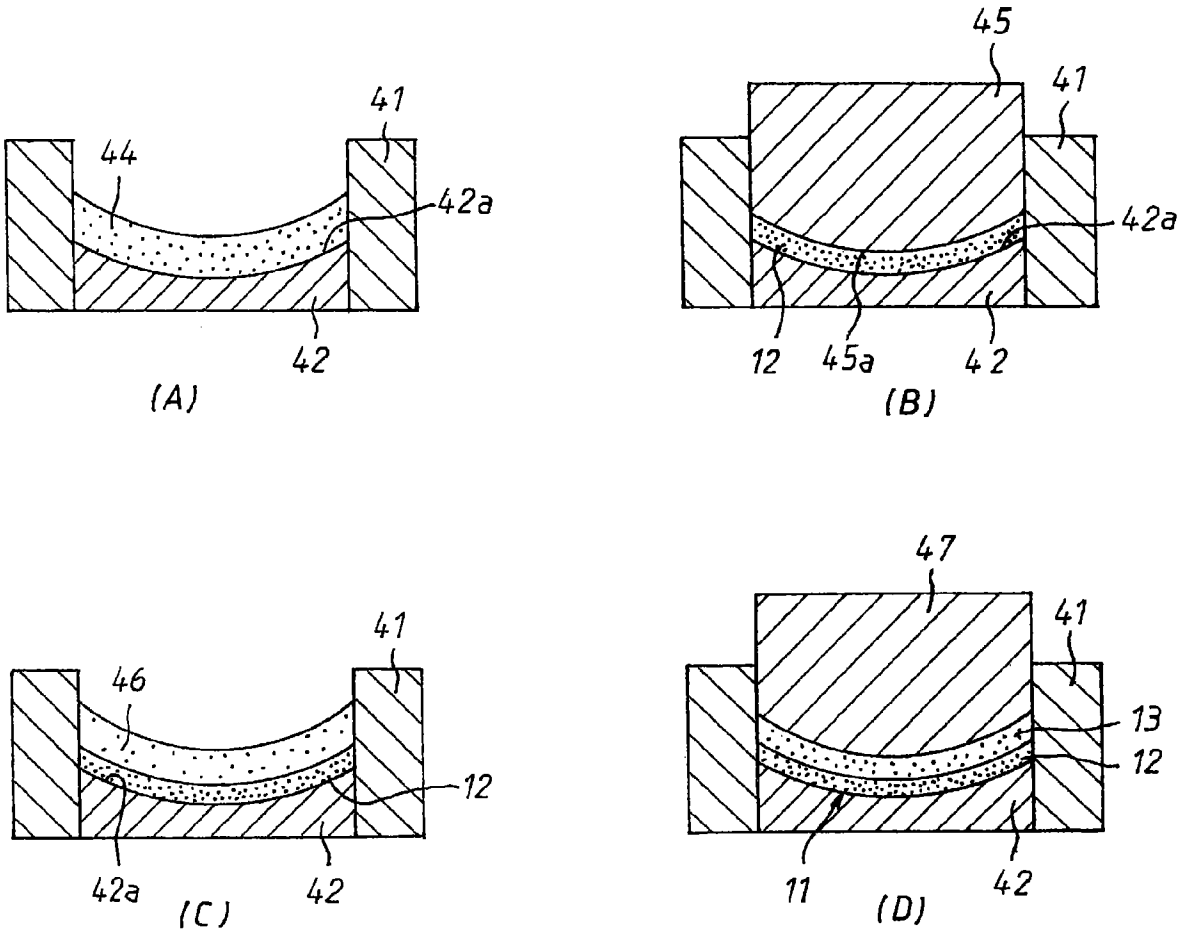
FIG. 10 illustrates processes in which the grinding chip is press-molded.
Figure 11:
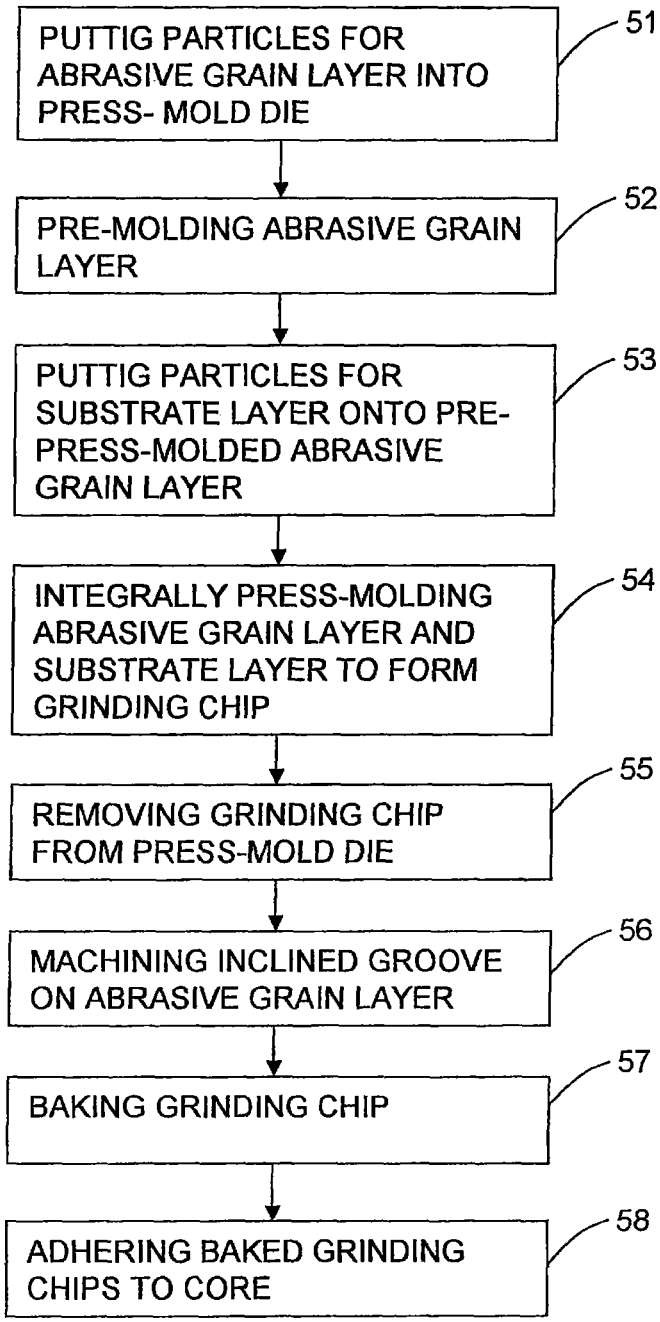
FIG. 11 illustrates processes in which the grinding wheel is manufactured.

As illustrated in FIG. 10C, particles 46 for an substrate layer which contains the grains 19 for the substrate layer are put onto the upper side of the abrasive grain layer 12 which is pre-press-molded in the outer die 41, and the particles 46 are leveled into uniform thickness (process 53). Next, as illustrated in FIG. 10D, a second upper die 47 is moved downward along the inner surface of the outer die 41, and the particles 46 and the particles 44 are pressed at the same time. Thus, the substrate layer 13 is overlaid on the inner surface of the abrasive grain layer 12 and integrally press-molded with the abrasive grain layer 12 to form the grinding chip 11 in an arcuate shape (process 54). The second upper die 47 is moved upward, and the grinding chip 11 is removed from the outer and lower dies 41, 42 (process 55).

Figure 12:
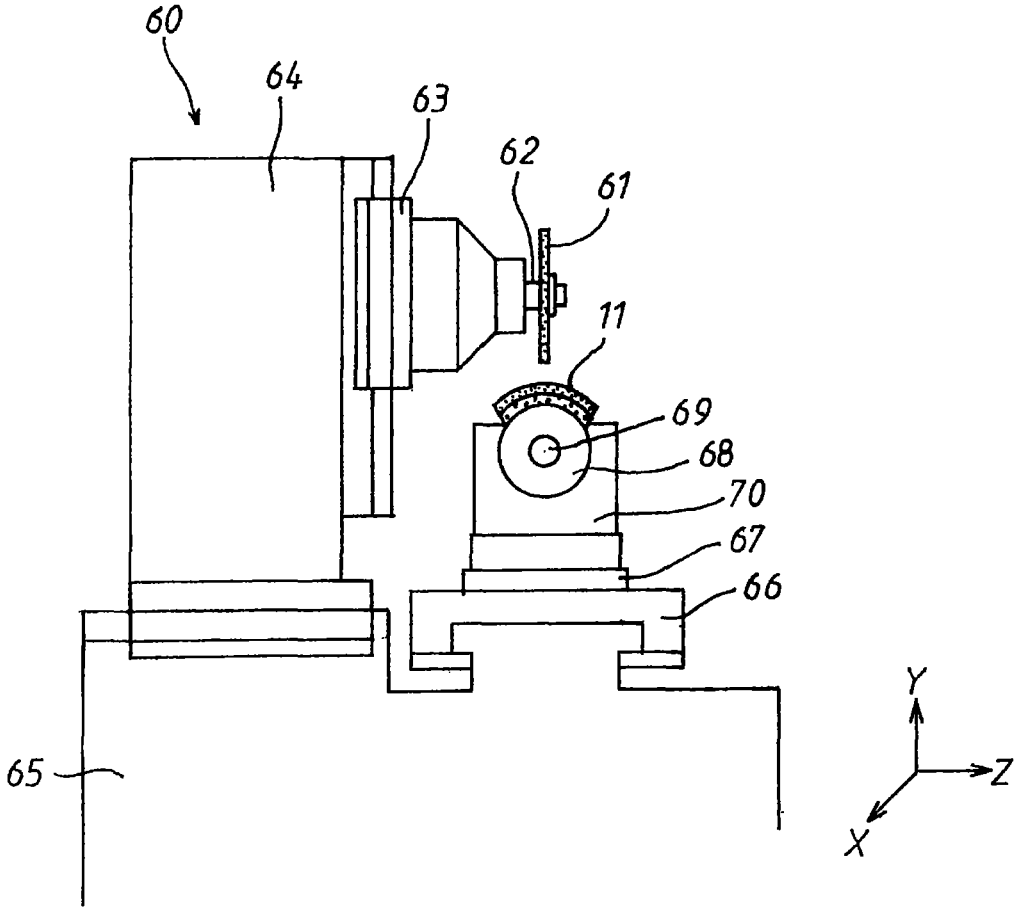
FIG. 12 illustrates a groove machining apparatus.

Prior to the baking process, the grinding chip 11 (non-baked grinding chip), is mounted and clamped on an arcuate surface formed on a jig, arcuate surface of which has a radius equal to a radius of the bottom surface of the substrate layer 13. The five inclined grooves 20 are formed linearly by machining with the circumferential pitch p, wherein each of the inclined grooves 20 reaches to the substrate layer 13 from the grinding surface 15 (process 56). The machining process can be performed by using a well-known groove machining apparatus 60 illustrated in FIG. 12. In the groove machining apparatus 60, for example, the grinding head 63 is mounted on a column 64 to be movable in a Y axis direction, or an up-down direction. The grinding head 63 supports a spindle rotatable about an axis parallel with a Z axis in a horizontal plane, to which a grinding wheel, or a tool 61 for machining a groove is attached. The column 64 is mounted on a bed 65 to be movable in the Z axis direction. Further, a worktable 66 is mounted on the bed 65 with facing to the column 64, and is movable in the X axis direction perpendicular to the Z axis direction in the horizontal plane. An index table 67 rotatable about a vertical axis is supported on the worktable 66. A headstock 70 for rotatably supporting a main spindle 69 is mounted on the index table 67. The main spindle 69 to which the jig 68 is attached is rotatable in a horizontal plane to be rotationally positioned at predetermined rotational positions.

Described hereinafter is a method for forming the inclined grooves 20. First, the arcuate surface of the substrate layer 13 of the grinding chip 11 is abutted on the jig 68, and the grinding chip 11 is clamped to the jig 68, so that the periphery of the abrasive grain layer 12 faces to the grinding wheel 61. Then the main spindle 69 is rotated to a rotational position where the circumferential rear end 11*r* of the grinding chip 11 coincides with the rotational axis of the main spindle 69 in a vertical direction. The index table 67 is rotated to an indexed position where the axis of the main spindle 69 is inclined relative to the Z axis direction with the inclination angle $\alpha$ of the inclined groove 20, so that a direction of the side surface of the grinding wheel 61 for machining a groove coincides with a direction of the inclined groove 20. The column 64 is positioned in the Z direction so that the grinding wheel 61 is aligned with the front half portion 20*f* of the inclined groove 20. Further, the grinding wheel head 63 is moved down to a position where the lower end surface of the grinding wheel 61 coincides with the bottom surface of the front half portion 20*f* of the inclined groove 20. The worktable 66 is moved in the X axis direction, so that the grinding wheel 61 for machining a groove moves linearly relative to the non-baked grinding chip 11 in the direction of the inclination angle $\alpha$ of the inclined groove 20. As illustrated in FIG. 3, the inclined groove 20 inclined relative to the circumferential direction of the grinding wheel 10 is formed linearly on the abrasive grain layer 12 of the non-baked grinding chip 11 through the machining process such that the inclined grooves 20 reach to the substrate layer 13 from the grinding surface 15. Subsequently, the column 64 is moved in the Z axis direction by a pitch in the normal direction of the inclined groove, and the above-mentioned operations are performed repeatedly to form the center portion 20*m*, the rear half portion 20*r* and both end portions 20*e* of the inclined groove 20 on the grinding chip 11.

Next, the grinding chip 11 on which the inclined grooves 20 are formed, is removed from the jig 68 of the groove machining apparatus 60 and is baked in a furnace (process 57), and thereafter finishing the manufacturing of the grinding chip 11. Since the grinding chip 11 is baked after the inclined grooves 20 are formed thereon, the superabrasive grains 16 exposed from the bond due to the machining process are coated and bonded with the vitrified bond 17 which is molten at the time when the grinding chip is baked. As a result, a retentivity of the superabrasive grains 16 is not reduced due to the machining process. Nineteen baked grinding chips 11 are adhered to the periphery of the core 14 in such a manner that at least two of inclined grooves 20 always pass through the grinding points P, independently of the rotational phase of the grinding wheel 10 (process 58).

Figure 2:
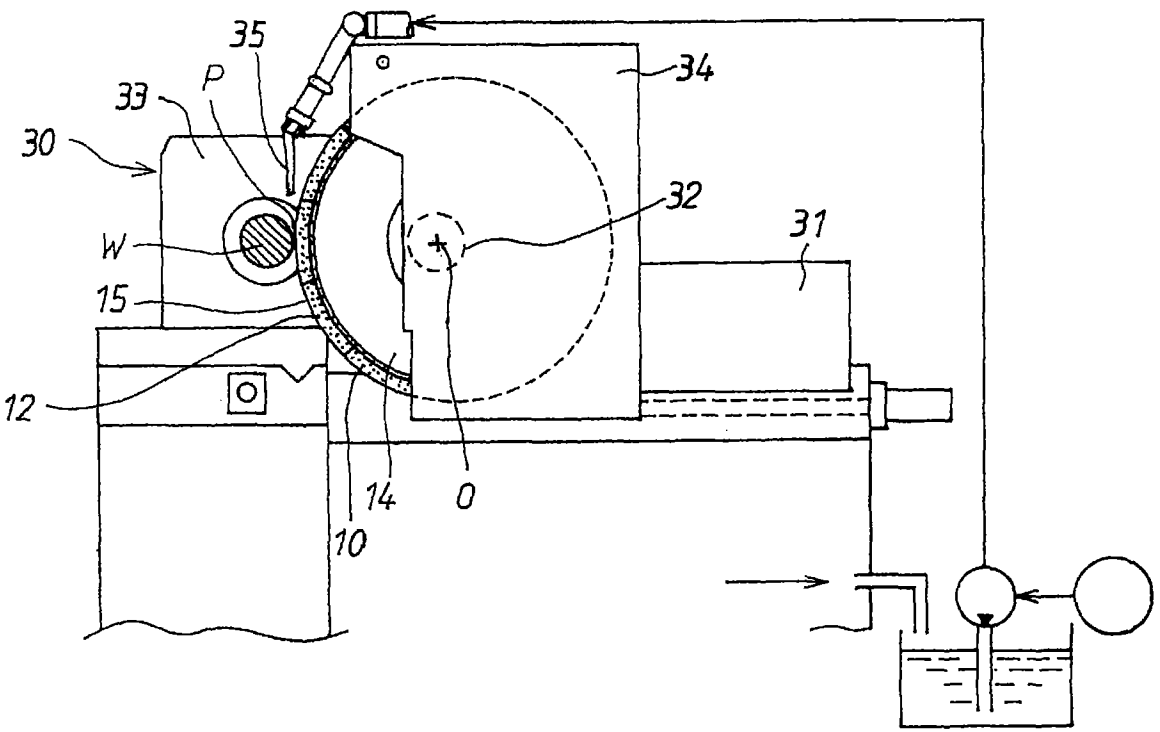
FIG. 2 illustrates a grinding machine on which the grinding wheel having inclined grooves is mounted to grind a workpiece.

Next, described hereinafter is the operation of the grinding wheel 10 manufactured by the method in accordance with the present embodiment. The core 14 of the grinding wheel 10 is fixedly fit to the wheel spindle 32, which is journalled in the grinding wheel head 31 of the grinding machine 30 and is rotated, as illustrated in FIG. 2. The workpiece W is mounted on the workpiece supporting apparatus 33 including a headstock and tailstock and is rotated thereon. Coolant that is supplied from a coolant nozzle 35 attached to a grinding wheel cover 34 is introduced to the grinding point P between the grinding wheel 10 and the workpiece W. The grinding head 31 is moved to the workpiece W, so that the workpiece W is ground by the grinding wheel 10. Because at least two of the plurality of the inclined grooves 20, each of which is inclined relative to the circumferential direction of the grinding wheel 10, always pass through the grinding points P, independently of the rotational phase of the grinding wheel 10, dynamic pressure generated in the grinding fluid supplied to the grinding point P between the grinding surface 15 and the workpiece W can be released from both upper side and lower side of the grinding point P. Therefore, the workpiece is not shifted in a direction apart from the grinding wheel 10, so that the diameter of the workpiece W is not increased. As a result, a grinding accuracy, especially out-of-roundness is improved.

Figure 13:
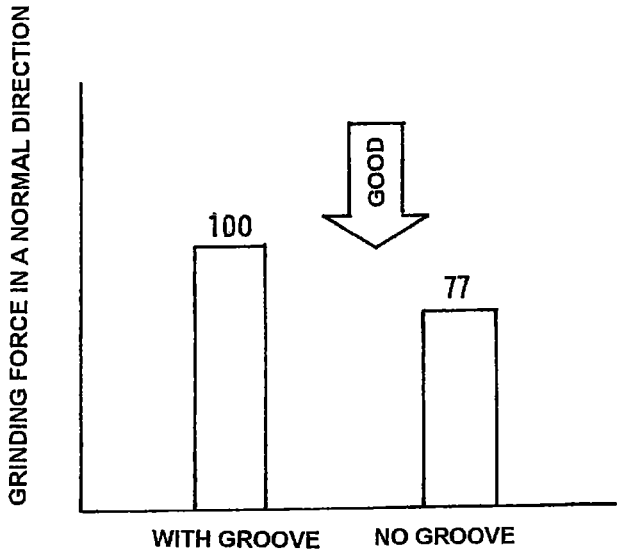
FIG. 13 illustrates improved ratios of a grinding force in a normal direction and profile accuracy in accordance with the grinding wheel having the inclined grooves.
Figure 13:
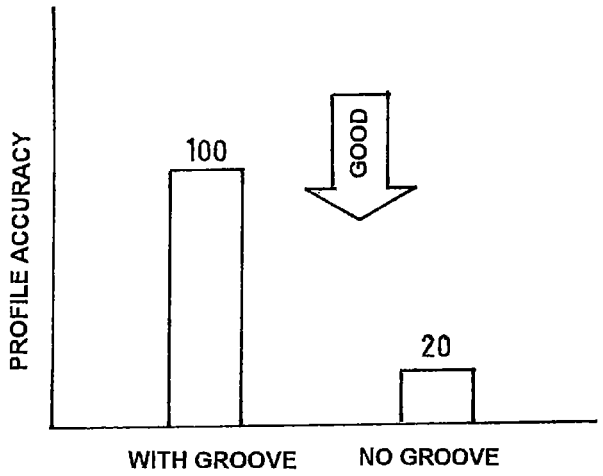

Now, grinding force and profile accuracy obtained in grinding operation where a hardened cam (workpiece W) made of steel is ground by the grinding wheel which is not formed the inclined grooves 20 on the grinding surface is compared with those obtained in the grinding operation where the same cam is ground by the grinding wheel which is made by the method in accordance with the present embodiment. The grinding wheel which is not formed the inclined grooves 20 on the grinding surface is made as follow. CBN grains having a grain size of #120 are bonded by the vitrified bond 17 at a concentration of 150 to make the abrasive grain layer 12. The mixed substrate grains with the bond 17 are overlaid on the inner surface of the abrasive grain layer 12, and the substrate layer 13 having no superabrasive grains is formed integrally with the abrasive grain layer 12 to make the grinding chip. The grinding chips are adhered to the periphery of the core 14 made of steel to make a grinding wheel with an outer diameter of 350 mm. The grinding wheel which is made by the method in accordance with the present embodiment has thirty nine inclined grooves 20 on the periphery thereof, the grooves of which have a groove width of 1 mm, a groove depth of 6 mm and an inclination angle α of 15 degree. Assuming that both of a grinding force in a normal direction and a profile accuracy are 100 in the case where the cam is ground by the grinding wheel without the inclined grooves 20, the grind force in the normal direction is reduced to 77, and the profile accuracy is improved to 20 in the case where the cam is ground by the grinding wheel that is formed the inclined grooves 20 (refer to FIG. 13).

In the above-described embodiment, when the inclined grooves 20 are formed by the groove machining apparatus 60, the grinding wheel 61 for machining a groove is moved linearly so that the each inclined groove 20 is formed on the non-baked grinding chip 11. However, the inclined grooves 20 may be formed as follows. The non-baked grinding chip 11 is mounted to the main spindle 69 of the groove machining apparatus 60 by means of the jig 68, and the index table 67 is rotated to an indexed position where the axis of the main spindle 69 is inclined relative to the Z axis direction with the inclination angle α of the inclined groove 20, so that a direction of the side surface of the grinding wheel 61 for machining a groove coincides with a direction of the inclined groove 20. Then, the column 64 and the worktable 66 are simultaneously moved in the Z axis direction and the X axis direction in connection with the rotation of the main spindle 69 so that the inclined grooves 20 having a spiral shape are formed on the abrasive grain layer 12, wherein each of the inclined grooves 20 reaches to the substrate layer 13 from the grinding surface 15.

Further, in the embodiment described above, the specifications for the inclined grooves are determined in a condition that the width of the workpiece W is smaller than the width of the grinding wheel 10, and the length of the grinding point P in the axis direction is equal to the width of the workpiece W. However, in the case where the width of the workpiece W is larger than the width of the grinding wheel 10, the specifications for the inclined grooves 20 may be determined in a condition that the length of the grinding point P in axis direction is equal to the width of the grinding wheel.

In the embodiment described above, the inclined grooves 20 are formed on the plurality of non-baked grinding chips in such a manner that at least two of the inclined grooves 20 pass through the grinding points P, independently of the rotational phase of the grinding wheel 10. However, at least one of the inclined grooves 20 may pass through the grinding point P.

In the embodiment described above, the inclined grooves 20 are formed on the abrasive grain layer 12 from the grinding surface 15 to a depth to reach to the substrate layer 13. However, the inclined groove 12 may be formed on the abrasive grain layer 12 to a predetermined depth in which the inclined grooves does not reach to the substrate layer 12.

The grinding wheel having inclined grooves, in which it is intended that the grinding fluid is effectively supplied to the grinding point along the inclined grooves, can be manufactured in the same way as the embodiment described above. The inclined grooves, each of which is inclined relative to the circumferential direction of the grinding wheel, are formed through the machining process on the abrasive layer of the non-baked grinding chip. Then the grinding chips on which the inclined grooves are formed are baked. Subsequently, the plurality of baked grinding chips are adhered to the core.

Next, a second embodiment of the present invention will be described in reference to drawings. The configuration of the grinding wheel 10, which includes the segment type grinding chip 11 manufactured by the method according to the second embodiment of the present invention, is the same as the configuration described in the first embodiment. Therefore, description for the configuration of the grinding wheel 10 in the second embodiment is omitted.

Figure 14:
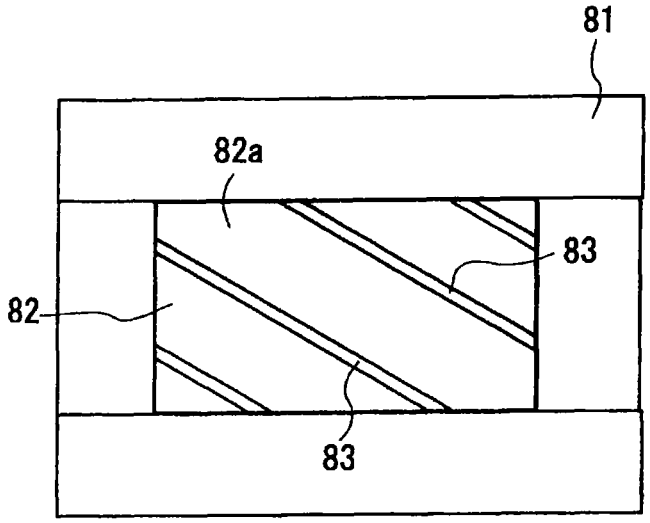
FIG. 14 is a plan view schematically illustrating a die for press-molding the grinding chip in accordance with a second embodiment of the present invention.
Figure 15:
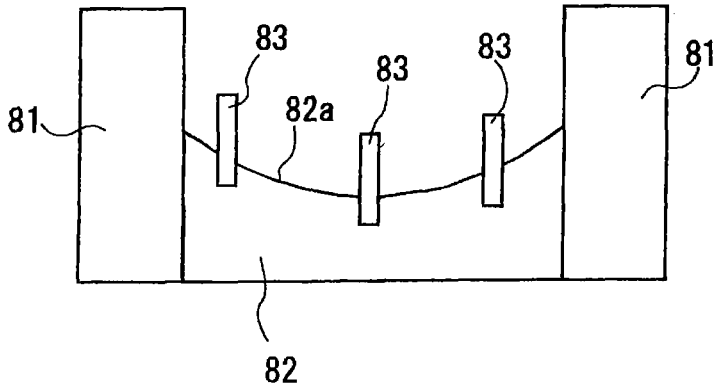
FIG. 15 is a cross sectional side view of the die shown in FIG. 14.

In the method according to the second embodiment, the inclined grooves 20 are formed on the grinding surface of the grinding chip 11 by press-molding. As illustrated in FIG. 14 and FIG. 15, a lower die 82 is inserted into a bottom portion of a rectangular through cavity that is formed through an outer die 81. An arcuate concavity 82*a* for press-molding an arcuate surface of a grinding chip 11 is formed on an upper surface of the lower die 82. The arcuate surfaces of grinding chips 11 compose an outer periphery of the grinding wheel 10. A plurality of mounting grooves corresponding to the inclined grooves 20 are formed on the lower die 82. And a plurality of inclined groove forming plates 83 for forming the plurality of inclined grooves are detachably fitted into the mounting grooves, so that the inclined groove forming plates 83 protrude upwardly from the bottom surface of the concavity 82*a*. The inclined groove forming plates 83 are made of materials such as carbon and are fitted into the mounting grooves to stand upward on the concavity 82*a* in such a manner that each inclined groove forming plate is inclined relative to a circumferential direction of the grinding wheel, when the grinding chip 11 is adhered to the core 14 of the grinding wheel. The outer die 81 and the lower die 82 constitute the press-mold die for press-molding the grinding chip 11, and the surface of the concavity 82*a* constitutes the grinding surface forming surface of the press-mold die for molding the grinding chip.

Figure 16:
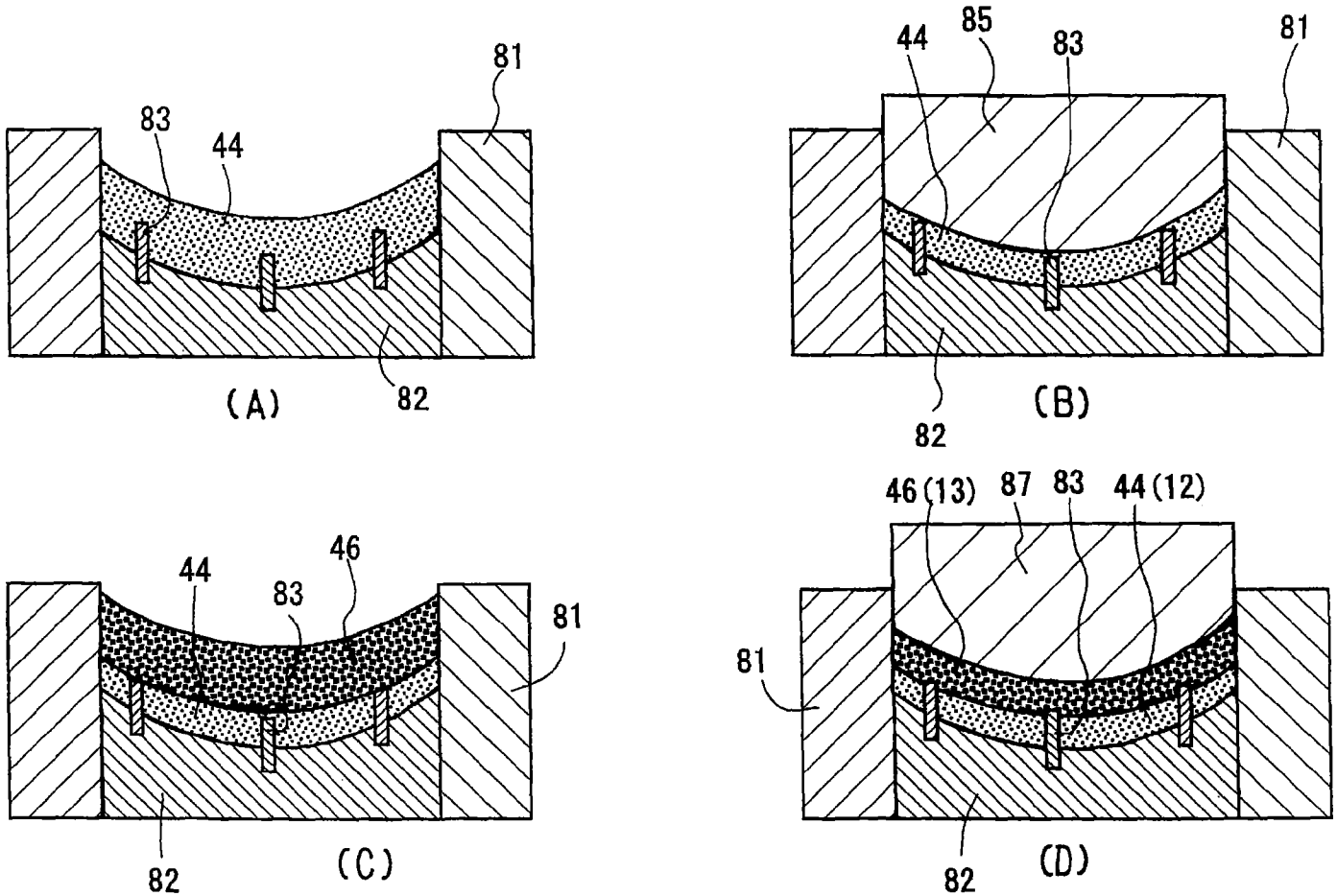
FIG. 16 illustrates processes in which the grinding chip having the inclined grooves is manufactured in accordance with the second embodiment.

As illustrated in FIG. 16A, particles 44 for the abrasive grain layer 12 containing materials such as superabrasive grains, the bond and aggregate grains are put onto the lower die 82 in the outer die 81 with the thickness where the inclined groove forming plates 83 are buried under the particles 44, and the particles 44 are leveled into uniform thickness.

Then, as illustrated in FIG. 16B, a first upper die 85 is moved downward into the outer die 81, and the particles 44 for the abrasive grain layer 12 is pre-pressed, so that the abrasive grain layer 12 is pre-molded in an arcuate shape. At this time, the inclined grooves are pre-formed on the outer surface of the pre-formed abrasive grain layer 12, the outer surface of which contacts with the lower die 82.

Subsequently, as illustrated in FIG. 16C, particles 46 for the substrate layer 13 containing substrate grains 19 are put onto the upper side of the pre-molded particles 44 for the abrasive grain layer 12 in the outer die 81, and the particles 46 are leveled into uniform thickness.

Next, as illustrated in FIG. 16D, a second upper die 87 is moved downward into the outer die 81, and the particles 46 and the particles 44 are pressed at substantially the same time. Thus, the substrate layer 13 is overlaid on the inner surface of the abrasive grain layer 12 and is integrally press-molded with the abrasive grain layer 12 to form the grinding chip 11 with an arcuate shape. The grinding chip 11 is press-molded such that each inclined groove forming plate 83 penetrates through the abrasive grain layer 12 and reaches to the substrate layer 13.

Then, the second upper die 87 is moved upward, and the grinding chip 11 is removed from the outer die 81 and the lower die 82. At the time when the grinding chip 11 is removed from the lower die 82, the plurality of inclined groove forming plates 83 are removed from the lower die 82 together with the grinding chip 11, in a state that each inclined groove forming plate 83 penetrates through the abrasive grain layer 12 of the grinding chip 12.

Afterward, the grinding chip 11, in which the plurality of inclined groove forming-plates 83 penetrate through the abrasive grain layer 12, is mounted on a table and baked. In the present embodiment, where the vitrified bond is used, the baking process is performed, for example, at 700~1000 degrees Centigrade in the atmosphere. Because carbon is usually burned away at about 700 degrees Centigrade, the inclined groove forming plates 83 made of carbon are burned away during the baking process, thus finishing the manufacturing of the grinding chip 11.

The grinding chips 11, after the baking process, are adhered to the periphery of the core 14 in such a manner that at least two of inclined grooves 20 pass through the grinding points P, independently of the rotational phase of the grinding wheel 10.

According to the method for manufacturing the grinding wheel, the non-baked grinding chip is formed in such a manner that the plurality of inclined groove forming plates 83 made of carbon for forming the inclined grooves 20 are disposed at the surface of the concavity 82*a* formed on the lower die 82, the particles 44 for the abrasive grain layer 12 are put into the press-mold die, and the particles 46 for the substrate layer 13 are put onto the particles 44 for the abrasive grain layer 12 in the press-mold die. The particles 44 for the abrasive grain layer 12 and the particles 46 for the substrate layer 13 are integrally press-molded in such a manner that the substrate layer 13 to be formed is not divided by the inclined groove forming plate 83, and the inclined grooves 20 are formed through the abrasive grain layer 12. Thus, the inclined grooves 20 inclined relative to the circumferential direction of the grinding wheel are formed on the abrasive grain layer 12. As a result, the process for only forming the inclined grooves can be eliminated. The machining process reduces the retentivity of the superabrasive grains. However, in the second embodiment, as it is not necessary to perform the machining process on the baked grinding chip 11 to form the inclined grooves 20, a retentivity of the superabrasive grains exposed on the grinding surface at the inside wall portions of the inclined grooves 20 is not reduced. Consequently, the highly durable grinding wheel 10 having superabrasive grains combined with the bond can be easily manufactured at a low cost.

In addition, since the inclined grooves 20 are formed by press-molding such that each inclined groove 12 reaches through the abrasive grain layer 12 to the substrate layer 13 from the grinding surface, the entire thickness of the abrasive grain layer is effectively used for grinding, thereby extending the lifetime of the grinding wheel.

The inclined groove forming plates 83 can be burned away at a high temperature while the grinding chip 11 is baked. Thereby, the process where the inclined groove forming plates 83 are removed from the non-baked grinding chip 11 can be eliminated to improve the manufacturing efficiency.

The operation of the grinding wheel 10 manufactured by the method in accordance with the second embodiment is the same as the operation described in the first embodiment. Thus, for the shake of convenience, descriptions of the operation in accordance with the second embodiment are omitted.

Figure 17:
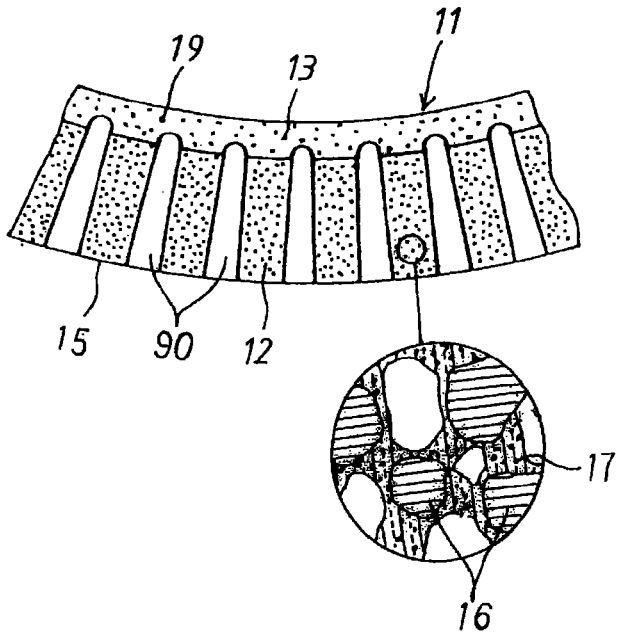
FIG. 17 illustrates a grinding chip having hole-shaped depressions in accordance with a third embodiment of the present invention.
Figure 18:
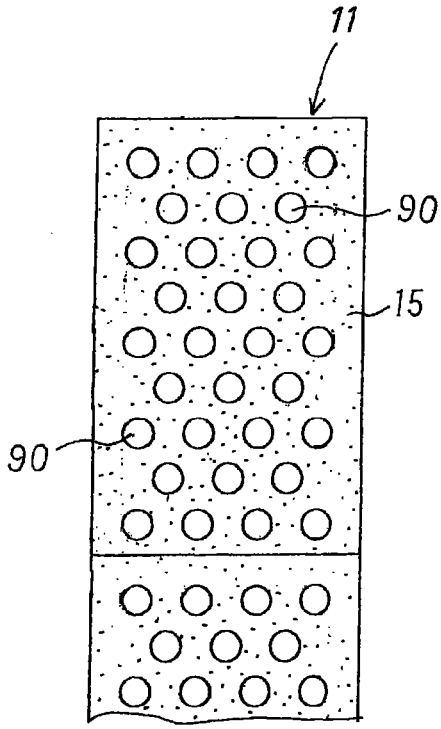
FIG. 18 illustrates the grinding surface with the plurality of hole-shaped depressions.

Next, a third embodiment of the present invention will be described with reference to drawings. In a configuration of a grinding wheel 10 including the segment type grinding chip 11 manufactured by a method in accordance with a third embodiment, a plurality of hole-shaped depressions 90 are formed on the grinding surface 15 of the grinding wheel, instead of the inclined grooves 20, such that the each hole-shaped depression 90 extends through the abrasive grain layer 12 and reaches to the substrate layer 13, as illustrated in FIG. 17 and FIG. 18. The description for other configurations which are the same as those in the first embodiment is omitted.

Figure 19:
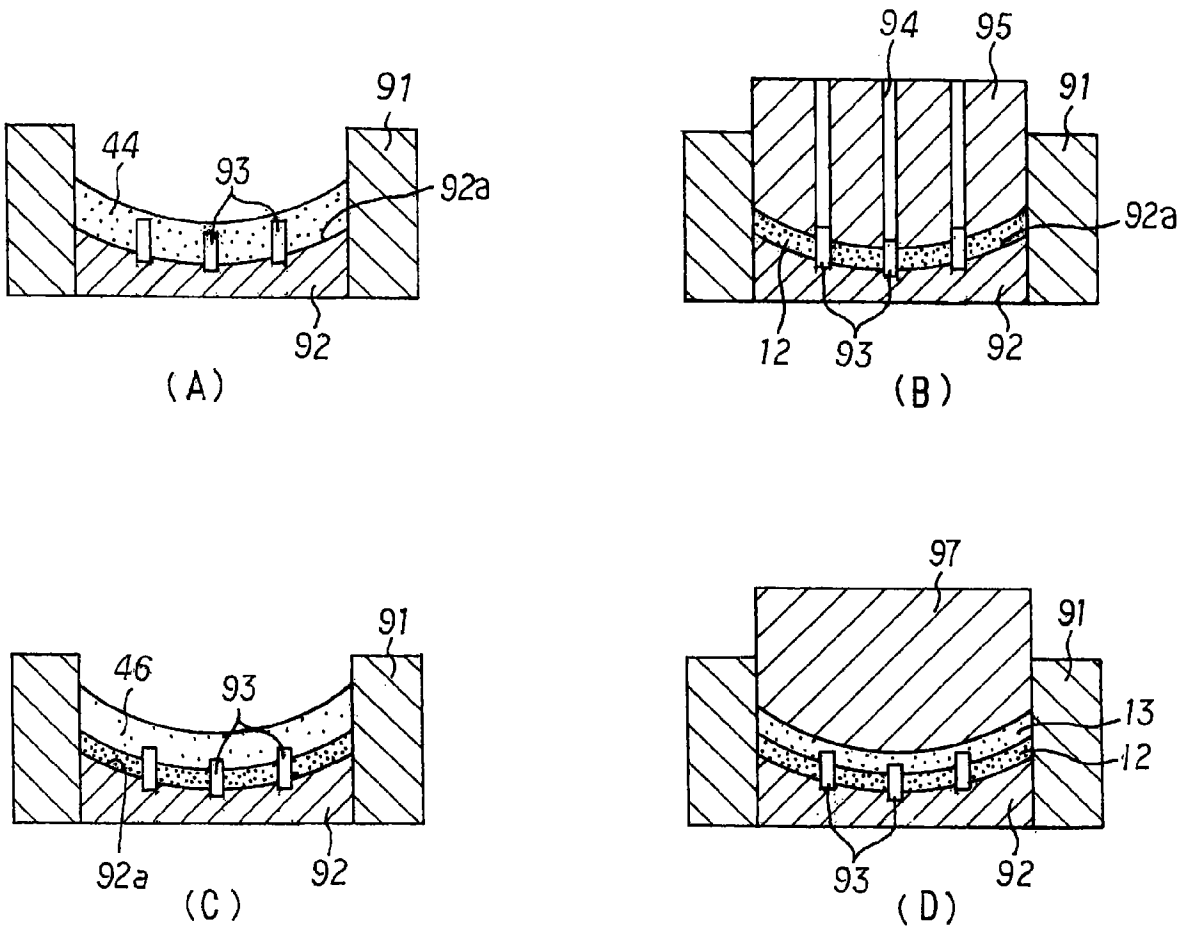
FIG. 19 illustrates processes in which the grinding chip having hole-shaped depressions is manufactured in accordance with the third embodiment.

According to the method for manufacturing the grinding chip 11 in accordance with the third embodiment, the plurality of hole-shaped depressions 90 are formed on the grinding chip 11 by press-molding. As illustrated in FIG. 19, a lower die 92 is fitted in a bottom portion of a rectangular through cavity formed through an outer die 91. An arcuate concavity 92*a* for press-molding an arcuate surface of a grinding chip 11 is formed on an upper surface of the lower die 92. The arcuate surfaces of grinding chips 11 compose an outer periphery of the grinding wheel 10. A plurality of mounting holes corresponding to the hole-shaped depressions 90 are formed on the lower die 92. And a plurality of pin members 93 for forming the plurality of hole-shaped depressions are detachably mounted to the mounting holes respectively, so as to protrudes upwardly from the bottom surface of the concavity 92*a*. The pin members 93 are made of materials such as carbon.

First, as illustrated in FIG. 19A, the particles 44 for the abrasive grain layer 12 which contains materials such as superabrasive grains, the bond and aggregate grains are put onto the lower die 92 in the outer die 91 with the thickness where the pin members 93 are buried under the particles 44, and the particles 44 are leveled into uniform thickness.

As illustrated in FIG. 19B, the first upper die 95 that is provided with a plurality of vertical clearance holes 94 corresponding to the plurality of pin members 93 is moved downward into the outer die 81. Thereby, the particles 44 are pre-pressed, and the abrasive grain layer 12 is press-molded in an arcuate shape. At this time, each pin member 93 penetrates through the abrasive grain layer 12 and fits slightly into each clearance hole 94.

Subsequently, as illustrated in FIG. 19C, particles 46 for the substrate layer 13 which contain substrate grains 19 and the bond are put onto the upper side of the pre-molded abrasive grain layer 12 in the outer die 91, and the particles 46 are leveled into uniform thickness.

Next, as illustrated in FIG. 19D, the second upper die 97 that is not provided with the clearance holes is moved downward into the outer die 91, and the particles 46 and the particles 44 (abrasive grain layer 12) are pressed at substantially the same time. Thereby, the substrate layer 13 is overlaid on the inner surface of the abrasive grain layer 12 and is integrally press-molded with the abrasive grain layer 12 to form the grinding chip 11 with an arcuate shape. At this time, the grinding chip 11 is press-molded such that the pin members 93 penetrate through the abrasive grain layer 12 and reach to the substrate layer 13.

Then, the second upper die 97 is moved upward, and the grinding chip 11 is removed from the outer die 91 and the lower die 92. At the time when the grinding chip 11 is removed from the lower die 92, the plurality of pin members 93 are removed from the lower die 92 together with the grinding wheel 11, in a state that each pin member 93 penetrates through the abrasive grain layer 12 of the grinding chip 12.

Subsequently, the grinding chip 11, in which the plurality of pin members 12 penetrate through the abrasive grain layer 12, is mounted on a table and is baked. In the present embodiment where the vitrified bond is used, the baking process is performed, for example, at 700~1000 degrees Centigrade in the atmosphere. Since carbon is usually burned away at about 700 degrees Centigrade, the pin members 93 made of carbon are burned away during the baking process, thus finishing the manufacturing of the grinding chip 11.

The baked grinding chips 11 are adhered to the periphery of the core 14 so that at least a few of hole-shaped depressions 90 are overlapped with the grinding point P of the grinding wheel 10, independently of the rotational phase of the grinding wheel 10.

The operation of the grinding wheel 10 manufactured by the method in accordance with the third embodiment will be described hereinafter.

When the workpiece W is ground by the grinding wheel 10 manufactured according to the present embodiment, the dynamic pressure generated by the grinding fluid supplied to the grinding point P is released by the plurality of hole-shaped depressions 90 which are overlapped with the grinding point P. Since the grinding fluid is supplied into the plurality of hole-shaped depressions 90, the grinding fluid is sufficiently supplied to the grinding point P so that heat generated by the grinding is surely emitted, and a capability for discharging swarf is improved because the swarf is disposed of into the plurality of hole-shaped depressions. Therefore, high speed grinding can be performed to improve the grinding efficiency. The explanation of other operations is omitted because it is the same as that in the first embodiment.

Figure 20:
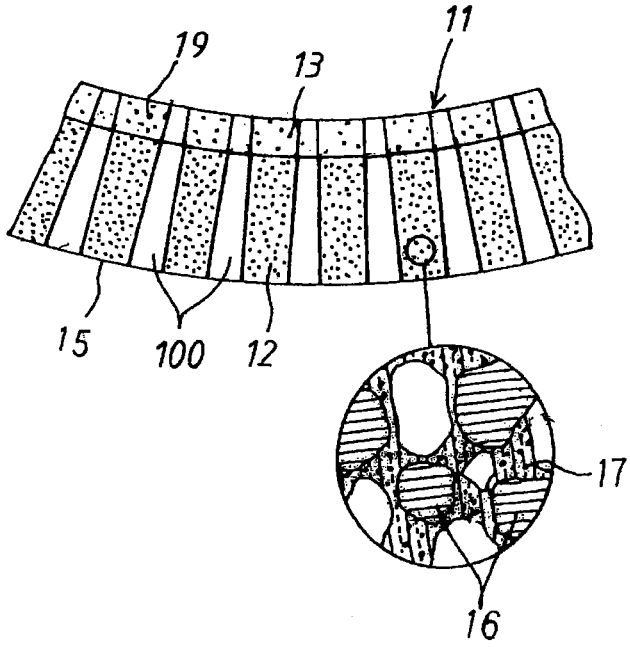
FIG. 20 illustrates a grinding chip having hole-shaped depressions in accordance with the fourth embodiment of the present invention.

A fourth embodiment of the present invention will be described with reference to drawings. In a configuration of a grinding wheel 10 including the segment type grinding chip 11 manufactured by a method in accordance with the fourth embodiment, a plurality of hole-shaped depressions 100 are formed on the grinding surface 15 of the grinding wheel 10 such that the each hole-shaped depression 90 is formed through both the abrasive grain layer 12 and the substrate layer 13, as illustrated in FIG. 20, which is different in configuration from the third embodiment. The description for other configurations which are the same as those in the third embodiment is omitted.

Figure 21:
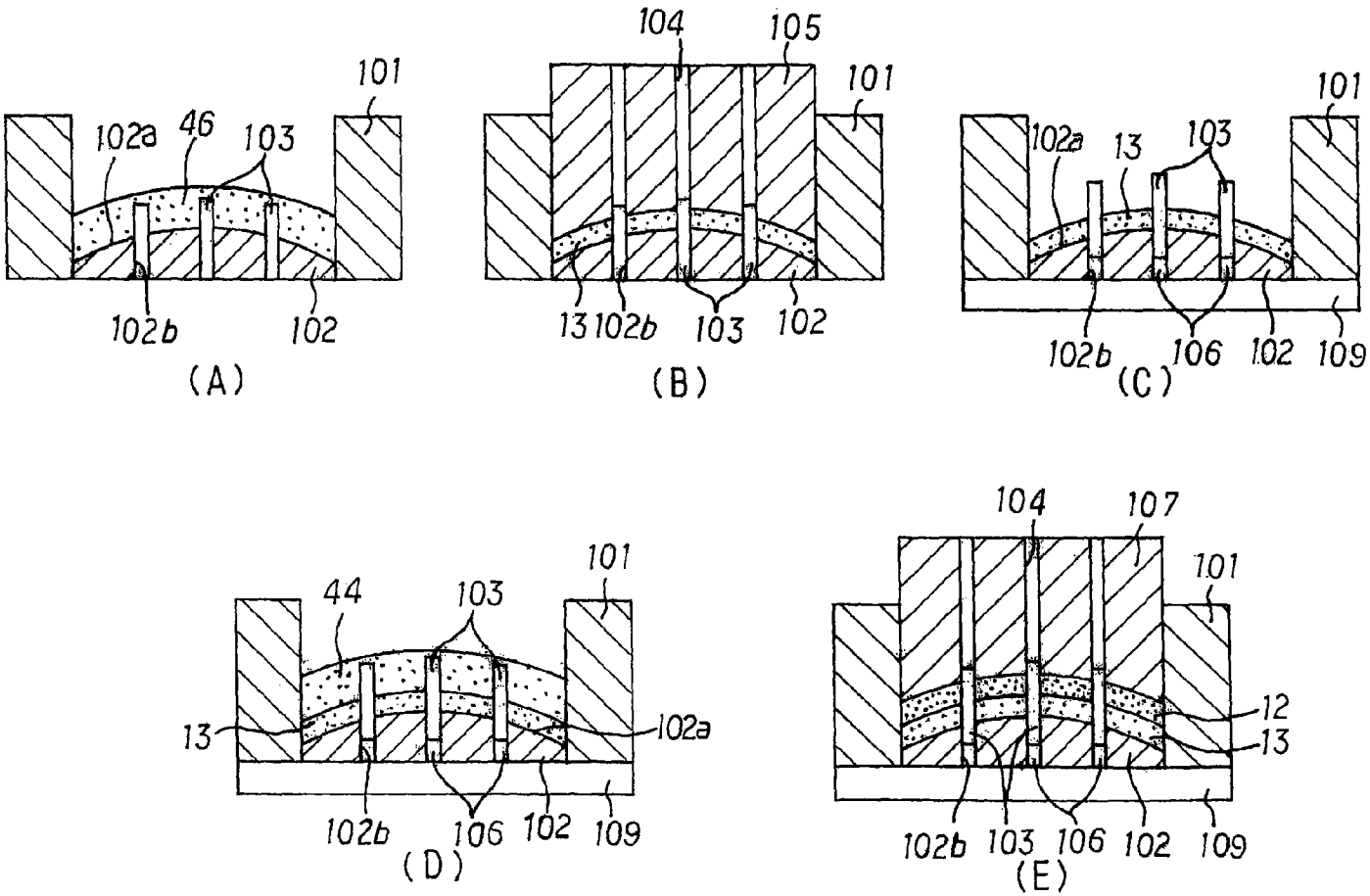
FIG. 21 illustrates processes in which the grinding chip having hole-shaped depressions is manufactured in accordance with the fourth embodiment.

The method for manufacturing the grinding chip 11 in accordance with the fourth embodiment will be described hereinafter in reference to FIG. 21. First, as illustrated in FIG. 21A, an arcuate convex surface 102*a* having a diameter equal to the outer diameter of the core 14 of the grinding wheel 10 is formed on an upper surface of a lower die 102 which is fitted in the bottom portion of a rectangular through cavity formed through an outer die 101. A plurality of insertion holes 102*b* corresponding to the plurality of hole-shaped depressions 100 are formed vertically on the lower die 102. A plurality of pin members 103 made of carbon are inserted into the insertion holes 102*b* to protrude upwardly from the convex surface 102*a* to form the plurality of hole-shaped depressions 100. And, particles 46 for the substrate layer 13 are put onto the lower die 102 in the outer die 101 with the thickness where the pin members 103 are buried under the particles, and then the particles 46 are leveled into uniform thickness.

Subsequently, as illustrated in FIG. 21B, the particles 46 are pre-pressed by a first upper die 105, in which a plurality of clearance holes 104 corresponding to the pin members 103 are formed vertically, and thereby the substrate layer 13 is pre-molded in an arcuate shape. At this time, the each pin member 103 penetrates through the particles 46 and fits slightly into the clearance hole 104.

Then, as illustrated in FIG. 21C, a tool 109 in which protrusion pins 106 corresponding to the insertion holes 102*b* are formed on an upper side thereof, is abutted into lower sides of the outer die 101 and the lower die 102, so that the protrusion pins 106 make the pin members 103 move upward by a length thereof.

Next, as illustrated in FIG. 21D, particles 44 for the abrasive grain layer 12 are put onto the upper side of the pre-molded particles 46 for the substrate layer 13 in the outer die 101 with the thickness where the plurality of pin members 103 are buried under the particles 44, and then the particles 44 are leveled into uniform thickness.

And, as illustrated in FIG. 21E, the particles 46 and the particles 44 are pressed simultaneously by a second upper die 107, so that the abrasive grain layer 12 is overlaid on the outer surface of the substrate layer 13 and is integrally press-molded with the substrate layer 13 to form the grinding chip 11 with an arcuate shape. At this time, each pin member 103 penetrates through the substrate layer 13 and the abrasive grain layer 12 and slightly fits into the each clearance hole 104 to form the plurality of hole-shaped depressions 100 extending through the grinding chip 11.

Subsequently, the upper die 107 is moved upward, and the grinding chip 11 is removed from the outer die 101 and the lower die 102. At the time when the grinding chip 11 is removed from the lower die 102, the plurality of pin members 103 are removed from the lower die 102 together with the grinding chip 11, in a state that the plurality of pin members 103 penetrate through the grinding chip 11.

Next, the grinding chip 11 into which the plurality of pin members 103 are inserted is mounted on a table and is baked. In the present embodiment where the vitrified bond is used, the baking process is performed, for example, at 700~1000 degrees Centigrade in the atmosphere. Since carbon usually is burned away at about 700 degrees Centigrade, the pin members 93 made of carbon are burned away during the baking process, thus finishing the manufacturing of the grinding chip 11. The baked grinding chip 11 is adhered to the periphery of the core 14.

The operation of the grinding wheel 10 manufactured by the method in accordance with the fourth embodiment is the same as the operation in the third embodiment. Thus, for the shake of convenience, descriptions of the operation of the grinding wheel in the fourth embodiment are omitted.

In the above-mentioned embodiments, the inclined groove forming plates and the pin members are made of carbon, but not limited to carbon. The inclined groove forming plates and the pin members can be made of any material that is burned away during the baking process. Hard resin, for example, may be preferable as the material for the plates and the pin members, which can be burned away at a temperature lower than the baking temperature. Also, the plates and the pin members may be made of materials such as steel. It is necessary to remove the plates and the pin members from the grinding chip before the baking process. If the machining process is performed on the baked grinding chip, the retentivity of the superabrasive grains is reduced by the machining process. However, as it is not necessary to perform the machining process on the baked grinding chip to form the inclined grooves or the hole-shaped depressions, a retentivity of the superabrasive grains exposed on the grinding surface at the inside wall portions of the inclined grooves or the hole-shaped depressions is not reduced by the machining process. Consequently, the highly durable grinding wheel having superabrasive grains combined with the bond can be easily manufactured at a low cost.

In addition, in the above-mentioned embodiments, the grinding chip is formed in an arcuate shape, but not limited to the arcuate shape. The grinding chip may be formed, for example, in a rectangular planar shape. In such a case, the non-baked rectangular planar grinding chip is mounted on a curved portion of a table, the diameter of which is equal to the outer diameter of the core of the grinding wheel. The non-baked rectangular planar grinding chip is bent along the curved portion of the table, and then is baked.

INDUSTRIAL APPLICABILITY

As described above, the method for manufacturing the grinding wheel having depressions on the grinding surface thereof according to the present invention is useful to manufacture the grinding wheel which is employed in the field of grinding machine for grinding workpieces such as machine parts at a high precision and a high speed.

The invention claimed is:

1. A method for manufacturing a grinding wheel having depressions on a grinding surface thereof, which comprises a plurality of grinding chips that include a substrate layer and an abrasive grain layer containing superabrasive grains, wherein the grinding chips are adhered to a core mounted to a wheel spindle that is rotatably journalled in a wheel head of a grinding machine, and the grinding surface formed on the abrasive grain layer contacts with a workpiece, which is rotatably supported on a workpiece supporting apparatus of the grinding machine, to grind the workpiece at a grinding point, wherein the method comprising the steps of:

forming the grinding chip before baking whereby a substrate layer formed by mixing substrate grains with bond is overlaid on an inner surface of an abrasive grain layer and is integrally press-molded with the abrasive grain layer to form the grinding chip with an arcuate shape, wherein the abrasive grain layer is formed by mixing superabrasive grains with the bond;

forming a plurality of depressions on an abrasive grain layer of the non-baked grinding chip using forming elements made of a combustible material;

baking the non-baked grinding chips in an atmosphere capable of combusting the forming elements made of a combustible material and at a temperature sufficient to combust the forming elements, thereby making baked grinding chips; and adhering a plurality of baked grinding chips to the core such that the grinding chips are circumferentially arranged on a radially outer periphery of the core, wherein the depressions are inclined grooves that are inclined relative to the circumferential direction of the grinding wheel, and wherein the inclined grooves are provided on the grinding chips with such a spacing and inclination that at least one of the inclined grooves always passes through a grinding point of the grinding wheel when the grinding wheel is rotated about a wheel axis of the grinding wheel to grind a workpiece at the grinding point.

2. The method for manufacturing a grinding wheel according to claim 1, wherein the inclined grooves reach to the substrate layer from the grinding surface.

3. The method for manufacturing a grinding wheel according to claim 1, wherein:

at the time when the press-molding is performed, disposing a plurality of inclined groove forming plates for forming the inclined grooves at a grinding surface forming surface of a press-mold die for molding the grinding chip, wherein the inclined groove forming plates are the forming elements made of a combustible material, are made of carbon or resin, and are respectively inclined relative to a direction corresponding to the circumferential direction of the grinding wheel where the grinding chips are to be adhered to the core thereof;

putting particles for the abrasive grain layer into the press-mold die, and putting particles for the substrate layer onto the particles for the abrasive grain layer to be overlaid on the abrasive grain layer in the press-mold die, wherein the particles for the abrasive grain layer is formed by mixing the superabrasive grains with the bond, and the particles for the substrate layer is formed by mixing substrate grains with the bond;

integrally press-molding the particles for the abrasive grain layer and the particles for the substrate layer, whereby the substrate layer to be formed is not divided by the inclined groove forming plate;

removing the non-baked grinding chip from the press-mold die, wherein the abrasive grain layer and the substrate layer are integrally press-molded in a state that the inclined groove forming plates penetrate through the abrasive grain layer; and at the time when the chip baking is performed, forming the baked grinding chip by baking the grinding chip in an atmosphere capable of burning away the inclined groove forming plates while the grinding chip is baked, and thereby the inclined grooves inclined relative to the circumferential direction of the grinding wheel are formed on the abrasive grain layer.

* * * * *